US005108011A

United States Patent [19]

Kobayashi et al.

[11] Patent Number: 5,108,011

[45] Date of Patent: Apr. 28, 1992

[54] ADHESIVE INJECTOR

[75] Inventors: Toshikatsu Kobayashi, Hyogo; Makoto Kita, Funahashi; Tsutom Matsuo, Osaka; Yoji Tokuda; Hidehiro Fujioka, both of Hyogo, all of Japan

[73] Assignees: Konishi Co., Ltd., Osaka; Sunkit Co., Ltd., Kobe, both of Japan

[21] Appl. No.: 606,096

[22] Filed: Oct. 31, 1990

[30] Foreign Application Priority Data

Jan. 17, 1990 [JP] Japan ..... 2-2800[U]

[51] Int. Cl.[5] ..... B67B 5/00

[52] U.S. Cl. ..... 222/153; 222/49; 222/386

[58] Field of Search ..... 222/43, 49, 153, 309, 222/384, 386, 402

[56] References Cited

U.S. PATENT DOCUMENTS

| | | | |
|---|---|---|---|
| 2,875,761 | 3/1959 | Helmer et al. | 222/43 X |
| 3,421,662 | 1/1969 | Hanson | 222/153 X |
| 3,881,360 | 5/1975 | Jurado | 222/309 X |
| 4,813,871 | 3/1989 | Friedman | 222/386 X |
| 4,861,401 | 8/1989 | Miura et al. | 156/94 |

*Primary Examiner*—Kevin P. Shaver
*Assistant Examiner*—Gregory L. Huson
*Attorney, Agent, or Firm*—Griffin, Branigan & Butler

[57] ABSTRACT

An adhesive injector has a piston inserted in a cylinder which is forwardly movable therein by a compressive force, the cylinder having a nozzle projecting from a front end portion thereof. The injector includes: a pair of holes defined adjacent each other in a rear end portion of the cylinder, a slit formed in the cylinder between the holes, a pin insertable through the holes, and cutout portions formed in the piston for engagement with the pin.

2 Claims, 1 Drawing Sheet

ADHESIVE INJECTOR

BACKGROUND OF THE INVENTION

1. Field of Invention

This invention relates to an injector for injecting adhesives of a type comprising a cylinder provided with a nozzle on a front end thereof and a piston which is movable forwardly in the cylinder by compressive means. Adhesive injectors of the type of this invention are particularly useful for repairing concrete constructions by injecting adhesives into cracks occurring in the concrete constructions by connecting the nozzles to injection pipes affixed at the cracks.

2. Description of Prior Art

Several dispensers or injectors of this kind are generally known to those skilled in the pertinent art, several having been disclosed in U.S. Pat. No. 4,861,401 and U.S. Pat. No. 3,905,521, for example.

The injector disclosed in U.S. Pat. No. 4,861,401 employs a method in which a piston is moved forwardly toward a front end by putting rubber belts between hook portions respectively provided on a rear end of the piston and a front end of a cylinder. Accordingly, it is necessary, when the injector is carried to a work location with the cylinder filled with adhesive, to apply the rubber belts for forward movement of the piston after the nozzle is connected to the injection pipe.

In this prior-art injecting method, however, there are several disadvantages to be overcome. The mentioned step of applying the rubber belt after connecting the nozzle to the injection pipe must be performed at a location of the injection work, during which the injector should be kept vertical. As a result, it sometimes happens that the injection pipe is broken due to an overload imposed trying to keep the injector vertical. Moreover, such a step as applying the rubber belt at the working location is not desirable from the viewpoint of working efficiency.

In the dispenser disclosed in U.S. Pat. No. 3,905,521 a coiled spring inserted in a cylinder is compressed to give impetus, or to drive, a piston during rearward movement thereof. A recess is provided in a main shaft of the piston, and movement of the piston is regulated by a pin, or sleeve, inserted in the cylinder at the recess, and retained at a rear edge portion of the cylinder, after filling the cylinder with adhesive.

In regulation of movement of the piston with such a sleeve inserted along the main shaft, there is a disadvantage of excessively large frictional resistance between the sleeve and the rear edge of the cylinder due to compressive force already given to the main shaft and concentrated thereon, eventually resulting in difficulty of drawing out the sleeve, or pin, when completing the connection of the nozzle to the injection pipe.

SUMMARY OF THE INVENTION

Accordingly, it is an object of this invention to provide an adhesive injector in which a piston moved forwardly by compressive means is inserted in a cylinder having a nozzle projecting from a front end portion, in which compressive force on the piston is regulated and released smoothly without resistance.

In order to accomplish the foregoing object, the injector in accordance with this invention is characterized by comprising:

(a) a pair of holes defined in the cylinder adjacent each other at a rear end of the cylinder;

(b) a slit formed in the cylinder between the holes;

(c) a pin inserted through the holes; and (d) cutout portions each formed on the piston to engage with the pin.

In the adhesive injector of the above construction, the holes provided on the rear end of the cylinder do not negatively affect either back and forth movements of the piston nor the engagement and disengagement of the pin.

The slit formed between the two holes serves as communication between them.

When inserting the pin through the two holes from outside the cylinder, after insertion of the piston in the cylinder, an intermediate portion of the pin extends through a bore, or the inside, of the cylinder.

Since cutout portions for engagement with the pin are provided on the piston, edges forming the cutouts of the piston come into engagement with the pin, which is inserted at the time the holes and cutout portions are in registration, so that the pin is retained at the holes, whereby there is no more forward movement of the piston even though a compressive force is given thereto.

Although the piston engages the pin when compressive force is given, the piston can still be turned circumferentially, about its axis, because the compressive force being applied in the axial direction does not serve as an obstructive resistance thereto.

When turning the piston circumferentially, a portion of the piston rod slidably contacting the inner periphery of the cylinder comes into contact with the pin. At this time, since the slit is formed between the two holes, the pin is pushed out of the slit to outside the cylinder.

The piston thusly disengaged from the pin automatically moves forward, receiving a compressive force from the compressing means, and the adhesive filling the cylinder is forced out through the nozzle.

In this manner, regulation of compressive force on the piston and release thereof can be easily accomplished.

As a result of this, in the adhesive injector of the above function, even when a compressive force is applied immediately after filling the cylinder with adhesive, there is no possibility of thrusting the adhesive out of the cylinder. This brings about an advantage of being able to carry the injector already provided with compressing means to work locations.

Since the injector already provided with compressing means is capable of being coupled with the injector pipe, injection of adhesive can be immediately started just by turning the piston. As a result, not only efficiency of injection work is improved but also the injection pipe is prevented from breaking.

Furthermore, since the piston moves forwardly after pushing the pin out of the cylinder to outside, there is no obstruction for such forward movement of the piston even when the piston rotates naturally, and the adhesive is smoothly forced out.

Other objects, features and advantages of the invention will become apparent in the course of the following description accompanied by the drawings.

BRIEF DESCRIPTION OF THE DRAWINGS

In the drawings forming a part of this application, and in which an embodiment in accordance with this invention is shown.

DESCRIPTION OF THE PREFERRED EMBODIMENT

Referring now to the accompanying drawings, an embodiment in accordance with this invention is hereinafter described.

Figure 1:
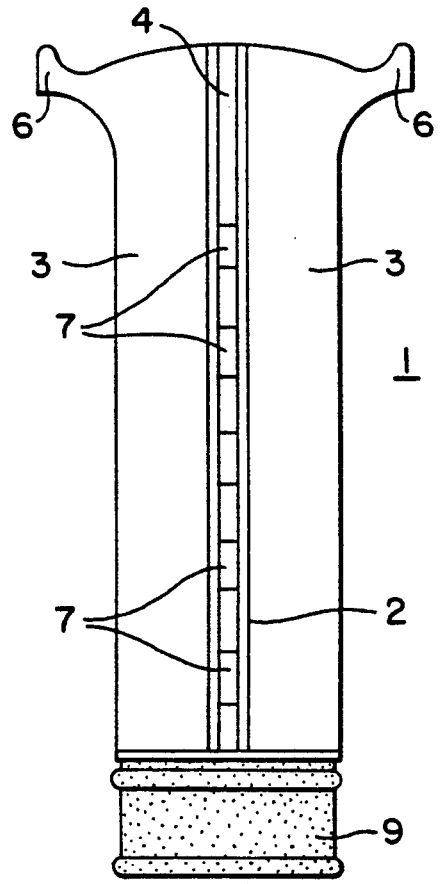
FIG. 1 is a side view of a piston of an adhesive injector of this invention.

In FIG. 1, showing a front view of a piston 1 of this invention, the piston 1 comprises a main shaft 2 (FIG. 3) provided with extending plates 3, 3 and 4, 4 and a compressing part 9 of rubber affixed onto a front end of the main shaft.

Figure 3:
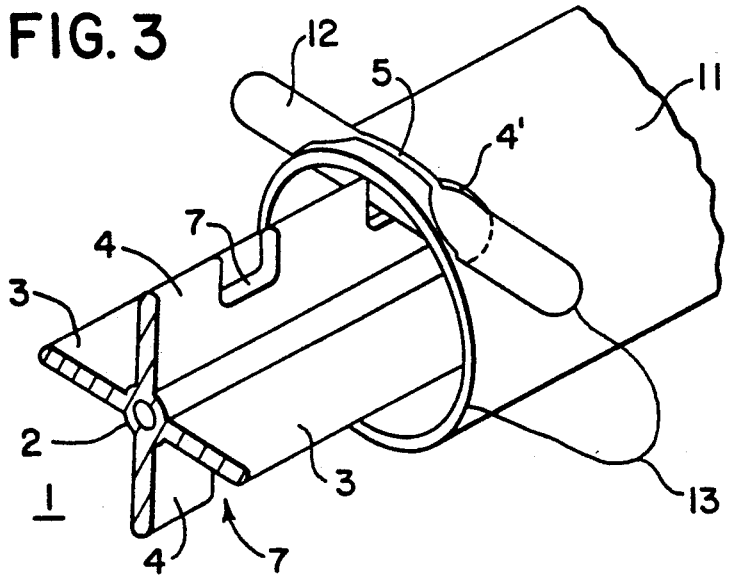
FIG. 3 is a perspective view of an essential part of the cylinder and piston with the piston in a retained state.

Hook portions, 6 to which rubber or springs are to be applied as described below, are formed on the extending plates 3, while multi-state, or step, cutout portions 7 for engagement are provided on outside edges of the extending plates 4 as shown in FIGS. 1 and 3.

Figure 2:
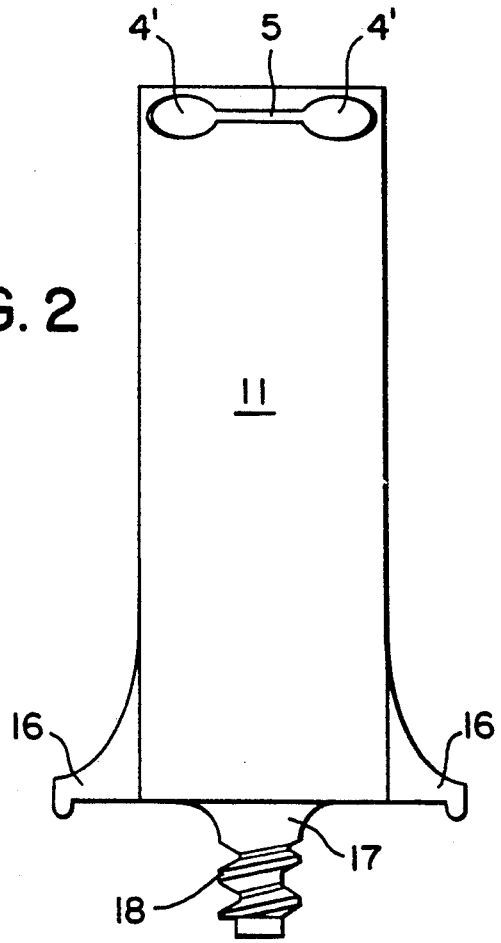
FIG. 2 is a side view of a cylinder of an adhesive injector of this invention.

A nozzle 17 is projected from a center portion of a front end of the cylinder 11 to be coupled with an injection pipe affixed at an injected surface, such as at a crack. The nozzle 17 is screw-threaded for engagement with the injection pipe as shown in FIG. 2. Numeral 18 denotes such a screw thread.

A pair of holes 4', 4' are provided on the rear end of the cylinder 11 so as to be circumferentially near other, and the holes 4' communicate with each to each other, and the holes 4' communicate with each other through a slit 5.

A pin 12 is inserted in the holes 4' 4' of the cylinder 11 and aligned with engaging cutout portions 7 of the piston after the cylinder 11 is filled with a predetermined amount of adhesive. In this embodiment, the pin 12 is attached to a holder 13 fastened to the cylinder 11, and kept close to the cylinder 11 even if the pin 12 gets out of the engagement shown in FIG. 3.

The inserted position of the pin 12 is stabilized by enlarging its base end portion so that the pin is exactly retained and held in both holes.

Further hook portions 16, 16 are provided on the top, or front, end of the cylinder 11 so that a rubber or spring (not illustrated) is applied between the hook portions 6 and 16 to give a compressive force. The piston 1, however, is inhibited by the pin 12 from forward movement.

Under these conditions, when the piston 1 is rotated circumferentially, about its axis of elongation, after coupling the cylinder 11 with the mentioned injection pipe, the extending plate 3, adjacent the extending plate 4 having the cutout portions 7, comes to push the pin 12, whereby the pin 12 applies force to spread the slit to get out of the cylinder to outside; thus, the piston 1 automatically moves forward within the cylinder 11.

Though the extending plates are provided on the main shaft of the piston and though the cutout portions for engaging the pin are formed on the side edge of the extending plates in the foregoing embodiment, it is also preferable that the main shaft be formed in conformity with an internal diameter of the cylinder to have multi-step engaging recesses on the surface of the main shaft.

For controlling the amount of adhesive by using a scale on the cylinder 11, if a distance of one cutout portion from another is set according to the scale, each of the cutout engaging portions 7 coincides positionally with the holes 4' when the cylinder 11 is filled with adhesive according to the scale.

Though the hook portions 16 on the cylinder are formed integrally with the cylinder 11 itself in the foregoing embodiment, it is also possible that recess grooves could be provided on the front end portion of the cylinder 11 so that a ring having engaging portions can be engaged with such recess grooves, otherwise a doughnut-shaped plate member having hook portions can be engaged outside the nozzle.

What is claimed is:

1. An adhesive injector of a type comprising a cylinder and a piston, with said piston being inserted into said cylinder and movable forwardly therein by a force applied thereto, said cylinder having a nozzle projecting from a front end portion thereof, wherein: said cylinder defines a pair of holes adjacent each other at a rear end portion of the cylinder; a slit is formed in the cylinder between said holes; said adhesive injector further includes a pin insertable through said holes so that an intermediate portion of said pin is positioned inside said cylinder; and said piston defines cutout portions along the length thereof, with edges defining said cutouts engaging said intermediate portion of said pin.

2. An adhesive injector as in claim 1 wherein said piston includes extending means for impinging on said pin when said piston is rotated in said cylinder and thereby forcing said pin out of said cylinder through said slit.

* * * * *